US010442671B2

(12) United States Patent
Hecht et al.

(10) Patent No.: US 10,442,671 B2
(45) Date of Patent: Oct. 15, 2019

(54) NOZZLE WITH ISOLATION PORTING

(71) Applicant: Automatic Bar Controls, Inc., Vacaville, CA (US)

(72) Inventors: Thomas R. Hecht, Winters, CA (US); Bret D. Baker, Vacaville, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 0 days.

(21) Appl. No.: 15/430,026

(22) Filed: Feb. 10, 2017

(65) Prior Publication Data

US 2017/0233234 A1 Aug. 17, 2017

Related U.S. Application Data

(60) Provisional application No. 62/294,892, filed on Feb. 12, 2016.

(51) Int. Cl.
*B67D 1/00* (2006.01)

(52) U.S. Cl.
CPC ..... *B67D 1/0052* (2013.01); *B67D 1/0021* (2013.01)

(58) Field of Classification Search
CPC ..... B67D 1/0052; B57D 1/0021
USPC ..... 222/145.3
See application file for complete search history.

(56) References Cited

U.S. PATENT DOCUMENTS 1,261,986 A 4/1918 White
2,515,570 A 7/1950 Rubinfield
3,009,653 A * 11/1961 Hedeman ..... B67D 1/0085 222/129.4
3,349,968 A * 10/1967 Yuza ..... B67D 1/0044 222/132
3,373,937 A * 3/1968 Yuza ..... B67D 1/1405 222/547
3,654,960 A 4/1972 Kiernan
3,664,550 A 5/1972 Carothers et al.
3,830,405 A 8/1974 Jaeger
(Continued)

FOREIGN PATENT DOCUMENTS

EP 0405032 A1 1/1991
EP 405032 A1 1/1991
(Continued)

OTHER PUBLICATIONS

International Search Report and Written Opinion dated Apr. 26, 2017 in International Patent No. PCT/US2017/017461,15 pages.
(Continued)

*Primary Examiner* — Patrick M. Buechner
*Assistant Examiner* — Michael J. Melaragno
(74) *Attorney, Agent, or Firm* — Kilpatrick Townsend & Stockton LLP

(57) ABSTRACT

Disclosed is a beverage dispensing system for dispensing a non-mixed fluid along with a post-mix fluid. The post-mix fluid is formed by mixing a base beverage with at least one beverage additive. For example, the beverage dispensing system may dispense a post-mix fluid (e.g. cola) and a non-mixed fluid (e.g. spirits) separately. In some embodiments, the post-mix fluid may be dispensed simultaneously with the non-mixed fluid from separate fluid outlet ports. In other embodiments, the post-mix fluid may be dispensed from a first fluid outlet port and, subsequently, the non-mixed fluid may be dispensed from a second fluid outlet port.

8 Claims, 7 Drawing Sheets

(56) References Cited

U.S. PATENT DOCUMENTS

| | | | | |
|---|---|---|---|---|
| 4,218,014 | A * | 8/1980 | Tracy | B05B 7/0408 222/144.5 |
| 4,270,673 | A * | 6/1981 | Rodth | B67D 1/0044 137/606 |
| 4,509,690 | A * | 4/1985 | Austin | B01F 5/08 222/129.1 |
| 4,619,378 | A * | 10/1986 | de Man | B67D 1/0049 137/607 |
| 4,708,266 | A | 11/1987 | Rudick | |
| 4,821,925 | A | 4/1989 | Wiley et al. | |
| 4,887,740 | A | 12/1989 | Smith | |
| 4,928,854 | A * | 5/1990 | McCann | B67D 1/0044 222/129.1 |
| D309,232 | S | 7/1990 | Valiyee et al. | |
| 4,979,639 | A | 12/1990 | Hoover et al. | |
| 4,986,447 | A * | 1/1991 | McCann | B67D 1/0044 222/129.1 |
| 5,033,651 | A * | 7/1991 | Whigham | B67D 1/0051 222/1 |
| 5,042,692 | A | 8/1991 | Valiyee et al. | |
| 5,190,188 | A | 3/1993 | Credle, Jr. | |
| 5,203,474 | A * | 4/1993 | Haynes | B67D 1/0044 222/129.1 |
| 5,415,326 | A | 5/1995 | Durham et al. | |
| 5,526,959 | A * | 6/1996 | Green | B67D 1/0051 222/129.4 |
| 5,803,320 | A | 9/1998 | Cutting et al. | |
| 6,039,219 | A | 3/2000 | Bach et al. | |
| 6,173,862 | B1 | 1/2001 | Buca | |
| 6,345,729 | B1 | 2/2002 | Santy et al. | |
| 6,401,981 | B1 * | 6/2002 | McCann | B67D 1/0042 222/129.1 |
| 6,601,741 | B2 | 8/2003 | McGuffey | |
| 6,698,621 | B2 | 3/2004 | Landers et al. | |
| 6,892,762 | B2 | 5/2005 | Porter et al. | |
| 7,445,133 | B2 * | 11/2008 | Ludovissie | B67D 1/0021 222/129.1 |
| 7,487,887 | B2 * | 2/2009 | Ziesel | B67D 1/0051 222/129.1 |
| 7,578,415 | B2 | 8/2009 | Ziesel et al. | |
| 7,658,006 | B2 | 2/2010 | Schroeder | |
| 8,528,786 | B2 * | 9/2013 | Gates | B67D 7/74 222/1 |
| 9,745,186 | B2 * | 8/2017 | Hecht | B67D 1/0052 |
| 2003/0098317 | A1 | 5/2003 | McGuffey | |
| 2003/0208299 | A1 | 11/2003 | Sudolcan et al. | |
| 2004/0118872 | A1 | 6/2004 | Romanyszyn et al. | |
| 2004/0206778 | A1 | 10/2004 | Awbrey | |
| 2004/0217130 | A1 | 11/2004 | Kado et al. | |
| 2005/0082313 | A1 * | 4/2005 | Fox | B67D 1/0021 222/129.1 |
| 2005/0115989 | A1 | 6/2005 | Ludovissie et al. | |
| 2006/0118581 | A1 | 6/2006 | Clark | |
| 2006/0196886 | A1 * | 9/2006 | Fox | B67D 1/0044 222/129.1 |
| 2006/0237479 | A1 * | 10/2006 | Fox | B67D 1/0021 222/129.1 |
| 2007/0029005 | A1 | 2/2007 | Huang et al. | |
| 2007/0114244 | A1 | 2/2007 | Gatipon | |
| 2007/0205219 | A1 * | 9/2007 | Ziesel | B67D 1/0051 222/129.1 |
| 2008/0037232 | A1 | 2/2008 | Schroetlin | |
| 2008/0223876 | A1 | 9/2008 | Schroeder | |
| 2009/0032609 | A1 * | 2/2009 | Ziesel | B67D 1/0044 239/10 |
| 2009/0230149 | A1 * | 9/2009 | Smeller | B67D 1/0044 222/145.5 |
| 2012/0055954 | A1 * | 3/2012 | Hecht | A47J 31/52 222/129.1 |
| 2014/0209629 | A1 | 7/2014 | Gates | |
| 2014/0305967 | A1 * | 10/2014 | Hecht | B67D 1/0052 222/129.1 |
| 2015/0315006 | A1 * | 11/2015 | Ziesel | B67D 1/0021 222/1 |
| 2017/0349423 | A1 | 12/2017 | Hecht et al. | |

FOREIGN PATENT DOCUMENTS

| | | | |
|---|---|---|---|
| EP | 0 989 091 | A1 | 3/2000 |
| EP | 1 316 368 | A1 | 6/2003 |
| EP | 1 955 977 | A1 | 8/2008 |
| EP | 1977668 | B1 | 8/2009 |
| GB | 1 300 072 | A | 12/1972 |
| GB | 2 442 223 | A | 4/2006 |
| GB | 2547339 | | 8/2017 |
| JP | 2003-026293 | A | 1/2003 |
| JP | 2006-160196 | A | 6/2003 |
| KR | 10-0135467 | B1 | 1/1998 |
| KR | 10-2001-0029306 | A | 4/2001 |
| KR | 20-2009-0004052 | A | 4/2009 |
| WO | 90/08728 | A1 | 8/1990 |
| WO | 92/08671 | A1 | 5/1992 |
| WO | 98/46519 | A1 | 10/1998 |
| WO | 2004/014781 | A2 | 2/2004 |
| WO | 2004/030438 | A2 | 4/2004 |
| WO | 2006/047083 | A1 | 5/2006 |
| WO | 2006/058692 | A1 | 6/2006 |
| WO | 2007/056407 | A2 | 5/2007 |
| WO | 2008/082394 | A1 | 7/2008 |
| WO | 2008/133491 | A1 | 11/2008 |
| WO | 2009/032686 | A1 | 3/2009 |

OTHER PUBLICATIONS

International Search Report and Written Opinion dated May 17, 2017 in International Patent Application No. GB1702262.5, 3 pages.

Non-Final Office Action dated Jul. 31, 2012 for U.S. Appl. No. 12/611/788, 11 pages.

Non-Final Office Action dated Jul. 18, 2018, for U.S. Appl. No. 15/687,264, 12 pages.

GB Office Action dated Oct. 9, 2012 for GB Patent Application No. GB091968.3, 5 pages.

Great Britain Search Report dated Mar. 9, 2010 for GB Patent Application No. GB091968.3, 4 pages.

Great Britain Search Report dated May 27, 2010 for GB Patent Application No. GB0919683.3, 3 pages.

Extended European Search Report dated Mar. 25, 2015 in European Patent Application No. 12828664.8, 8 pages.

International Search Report and Written Opinion of the International Searching Authority dated Feb. 9, 2012 for PCT Patent Application No. PCT/US2011/042053, 13 pages.

International Search Report and Written Opinion of the International Searching Authority dated Jan. 30, 2013 for PCT Patent Application No. PCT/US2012/052697, 9 pages.

International Search Report and Written Opinion dated Aug. 18, 2014, from PCT Application No. PCT/US/2014/034170, 11 pages.

Extended European Search Report for EP Application No. 17750866.0 dated Aug. 19, 2019, 9 pages.

* cited by examiner

NOZZLE WITH ISOLATION PORTING

CROSS-REFERENCES TO RELATED APPLICATIONS

This application claims the benefit of U.S. Patent Application 62/294,892 filed on Feb. 12, 2016 which is incorporated herein.

This application is related to U.S. patent application Ser. No. 14/253,736, filed Apr. 15, 2014, and U.S. patent application Ser. No. 13/220,546, filed Aug. 29, 2011, the disclosures of which are hereby incorporated by reference in their entirety.

BACKGROUND OF THE INVENTION

Conventional beverage dispensing systems are commonly used in a wide variety of locales, including restaurants, snack bars, convenience stores, movie theaters, and any business where beverages are served. These beverage dispensing systems often dispense a variety of beverages of differing types and flavors, such as flavored carbonated sodas, iced tea, water, or even alcoholic beverages. Typically, such devices use a post mix dispenser that mixes a beverage additive (e.g., a flavored syrup) with a base beverage fluid (e.g., water or soda) before discharging through a discharge nozzle into a beverage container. Many such beverage dispensing systems, often referred to as a beverage tower, utilize a dedicated nozzle for each flavor or beverage. Since each nozzle typically require a minimum clearance around the discharge nozzle for placement of a beverage container under the nozzle, these configuration can result in relatively large devices. Often, the more beverages a device is configured to provide, the wider the device becomes. This can be problematic since often these devices are set-up in places of business to allow self-service by customers and larger devices are generally undesirable as they occupy valuable floor space.

To address this problem, multiple beverage dispensing devices that dispense beverages of differing types and flavors from a single discharge nozzle have been developed. Although conventional devices that use a single discharge nozzle to dispense multiple differing beverages can significantly reduce the amount of floor space dedicated to beverage dispensing, these devices present their own drawbacks.

One commonly encountered problem when dispensing differing beverages through a single discharge nozzle is cross-contamination and/or color carry-over between beverages. In cross-contamination, residual beverage additive from dispensing a first beverage left on one or more components within the discharge nozzle may contaminate a subsequently dispensed beverage. For example, residual lemon flavored additive may inadvertently mix with subsequently discharged water causing a noticeable, unpleasant taste or smell, or residual sugars from a "sugared" drink, such as a regular cola, could mix with a non-sugared drink, such as a diet beverage. In color carry-over, a residual coloring additive from one beverage may "carry over" or contaminate a subsequently discharged beverage leading to a discolored beverage. For example, when dispensing a beverage having darker coloring additives, such as a cola beverage, a residual amount of the cola colorant may contaminate and discolor a subsequently dispensed clear beverage, such as water or a lemon-lime soda, or a clear beverage may be contaminated with a red-colored beverage additive resulting in an undesirable red or pink colored beverage.

Another drawback is that the mixing of the beverage additive and beverage base within the nozzle may result in undesirable splashing or travel of residual beverage additive, particularly in a device that dispenses differing beverages from a single discharge nozzle. In attempting to avoid leaving residual beverage additive within the nozzle, multiple beverage dispensing devices may reduce mixing of the components within the nozzle, which may result in adequate mixing of the beverage additive and beverage base. The beverage additive and base beverage must be adequately mixed to ensure consistency and quality of the discharged beverage.

One problem associated with multiple beverage dispensing devices is that the viscosity of the beverage additive may contribute to the above noted contamination and cross-over problem. Dispensing of particularly viscous beverage additives, such as flavored syrups, may result in delayed dripping from the channel opening or transfer of residual droplets onto adjacent additive discharge orifices due to surface tension of the viscous beverage additive. Given the close proximity of the fluid channel openings, residual droplets of beverage additives can easily "travel" to an adjacent fluid channel opening, thereby resulting in contamination or color carry-over of a subsequently discharged beverage.

Accordingly, it is desirable to develop methods and systems that overcome the aforementioned deficiencies of conventional beverage dispensing devices. Embodiments of the invention, individually and/or collectively, provide for improved devices that address these and other problems associated with dispensing of multiple beverages.

BRIEF SUMMARY OF THE INVENTION

Embodiments provide beverage dispensing system comprising a diffuser block, a transition plate coupled to the diffuser block and an external port nozzle coupled to the transition plate. The diffuser block includes a primary outlet port configured to dispense a first beverage fluid and a plurality of secondary outlet ports disposed around the primary outlet port. The secondary outlet ports of the diffuser block are configured to dispense a second beverage fluid. The transition plate includes a plurality of channels provided on a top surface of the transition plate, and a plurality of outer outlet ports, provided on a bottom surface of the transition plate, in fluid communication with a first set of the channels of the transition plate. At least one of the plurality of channels is in fluid communication with at least one of the secondary outlet ports of the diffuser block for receiving the second beverage fluid. The external port nozzle includes a primary outlet port and a plurality of secondary outlet ports disposed around the primary outlet port. The secondary outlet ports of the external port nozzle are in fluid communication with one or more of the outer outlet ports of the transition plate. A portion of the second beverage fluid flows through the one or more of the outer outlet ports of the transition plate and the secondary outlet ports of the external port nozzle without being mixed with the first beverage fluid.

Embodiments also provide a beverage dispensing nozzle assembly comprising an external port nozzle, a diffuser assembly provided in a hollow cavity of the external port nozzle and a transition plate coupled to a top surface of the external port nozzle. The external port nozzle includes a primary outlet port and at least one secondary outlet port provided on a bottom surface of the external port nozzle. The diffuser assembly is embedded within the external port nozzle. The transition plate is configured to receive a first beverage fluid and a second beverage fluid. A first portion of the second beverage fluid flows through at least one outer outlet port of the transition plate and at least one outlet port of the external port nozzle without being mixed with the first beverage fluid.

Embodiments further provide a transition plate configured to be coupled to a beverage diffuser block. The transition plate includes a primary inlet port provided on a top surface of the transition plate, the primary inlet configured to receive a first beverage fluid. The transition plate also includes a plurality of channels disposed around the primary inlet port, the plurality of channels are configured to receive a second beverage fluid. The transition plate also includes a primary outlet port provided on a bottom surface of the transition plate, the primary outlet port in fluid communication with the primary inlet port. The transition plate also includes a plurality of inner outlet ports disposed around the primary outlet port on the bottom surface of the transition plate, in fluid communication with a first set of the channels of the transition plate. The transition plate also includes a plurality of outer outlet ports disposed around the inner outlet ports, in fluid communication with a second set of the channels.

These and other embodiments of the invention are described in further detail below.

DETAILED DESCRIPTION OF THE INVENTION

Beverage Dispensing System

Embodiments are directed to a beverage dispensing system that is capable of dispensing a non-mixed fluid along with a post-mix fluid. The post-mix fluid is formed by mixing a base beverage (e.g. club soda) with at least one beverage additive (e.g. syrup). For example, the beverage dispensing system may dispense a post-mix fluid (e.g. cola) and a non-mixed fluid (e.g. spirits) separately. In some embodiments, the post-mix fluid may be dispensed simultaneously with the non-mixed fluid from separate fluid outlet ports (e.g. dispensing orifices of fluid channels). In other embodiments, the post-mix fluid may be dispensed from a first fluid outlet port (e.g. the outlet port of a first fluid channel) and, subsequently, the non-mixed fluid may be dispensed from a second fluid outlet port (e.g. the outlet port of a second fluid channel).

Figure 1A:
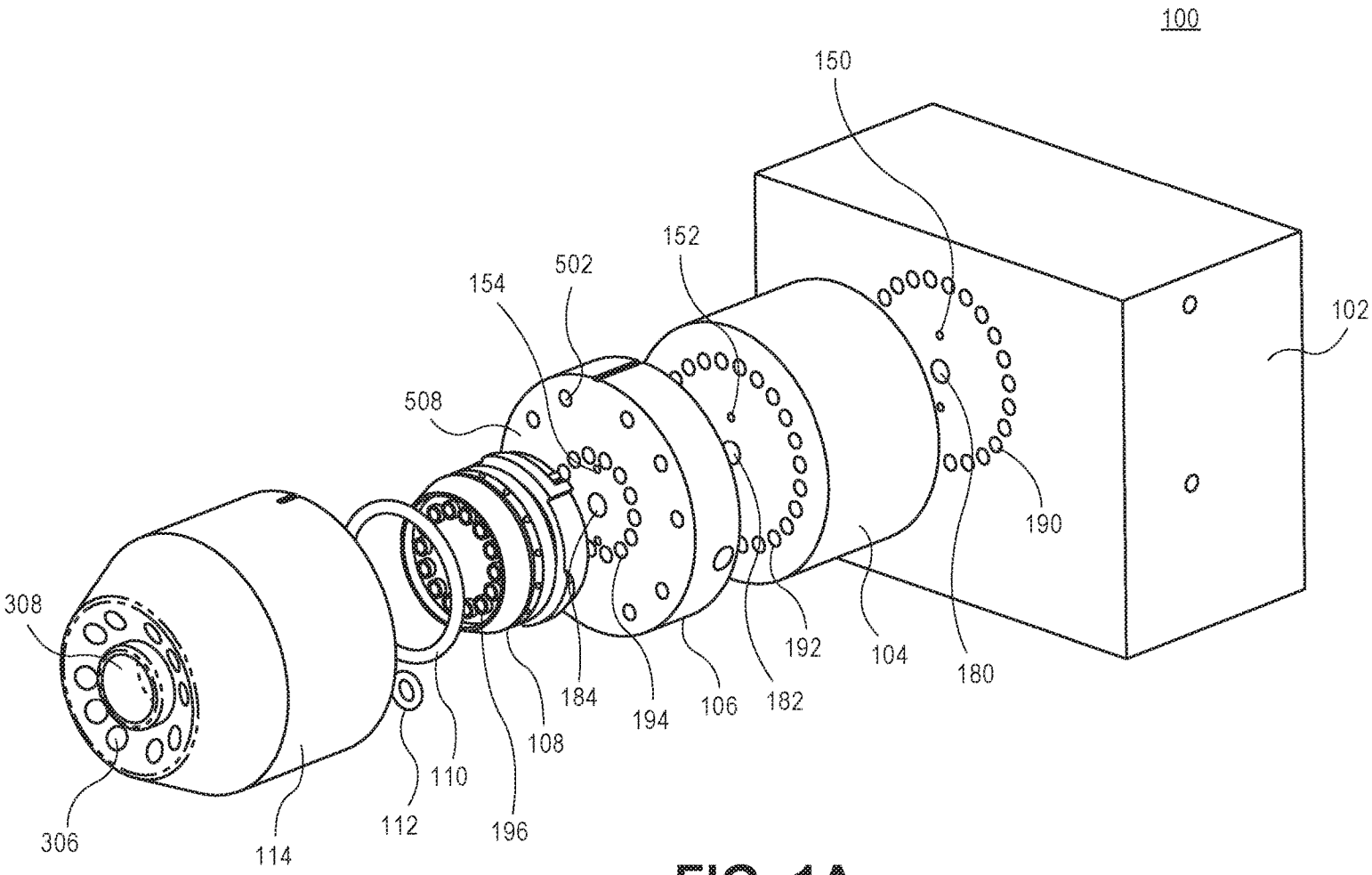
FIG. 1A is an exploded side-perspective view of a beverage dispensing system according to many embodiments.
Figure 1B:
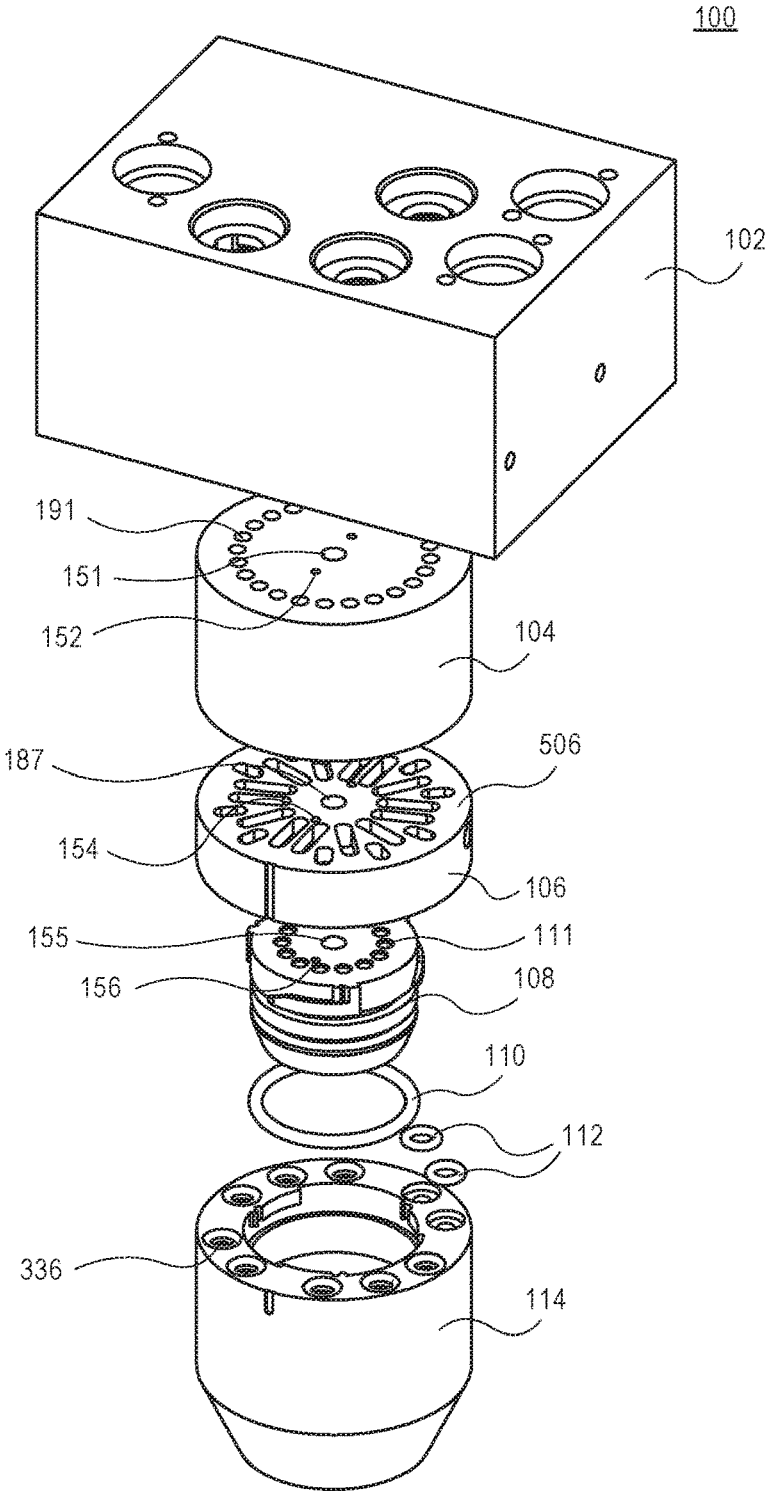
FIG. 1B is an exploded front-perspective view of the beverage dispensing system according to many embodiments.
Figure 1C:
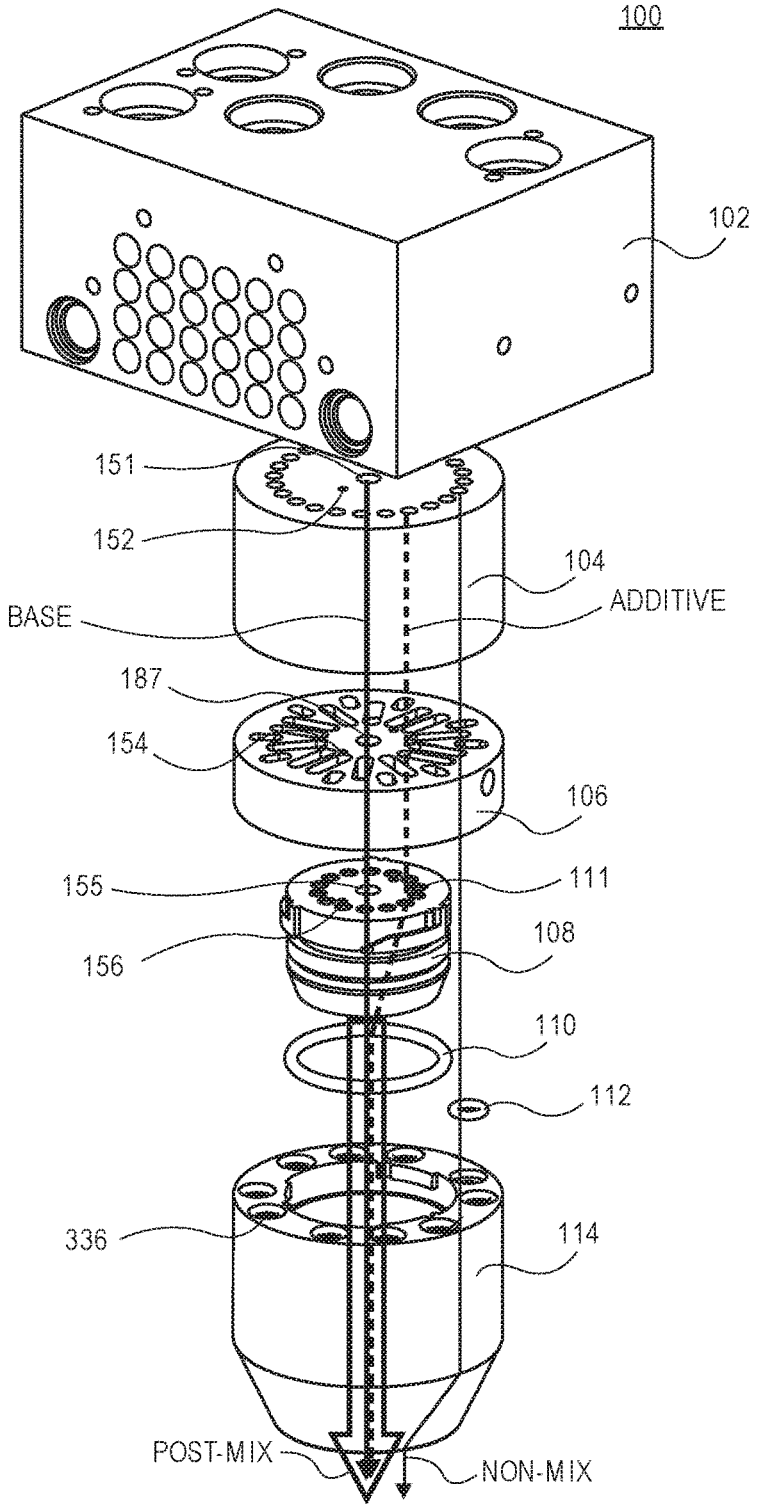
FIG. 1C is an exploded back-perspective view of a beverage dispensing system according to many embodiments.
Figure 2B:
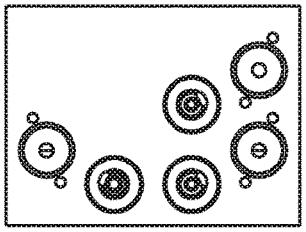
FIG. 2B is a plan view of the beverage dispensing system illustrated in FIGS. 1A-1C in its assembled state according to many embodiments.
Figure 2A:
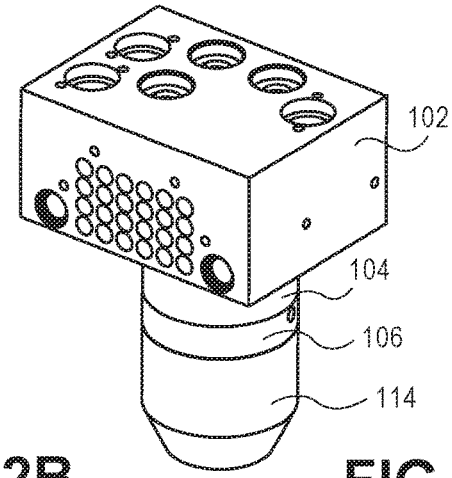
FIG. 2A is a back-perspective view of the beverage dispensing system illustrated in FIGS. 1A-1C in its assembled state according to many embodiments.
Figure 2C:
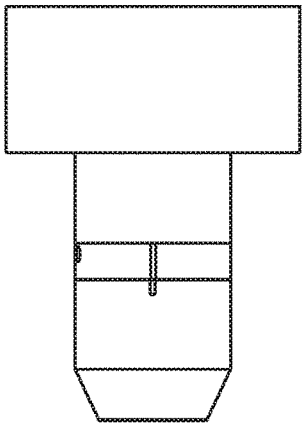
FIG. 2C is a front view of the beverage dispensing system illustrated in FIGS. 1A-1C in its assembled state according to many embodiments.
Figure 2D:
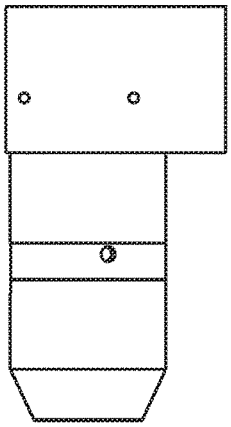
FIG. 2D is a side view of the beverage dispensing system illustrated in FIGS. 1A-1C in its assembled state according to many embodiments.
Figure 2E:
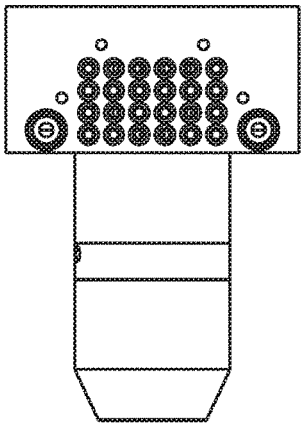
FIG. 2E is a back view of the beverage dispensing system illustrated in FIGS. 1A-1C in its assembled state according to many embodiments.

Referring to FIGS. 1A-1C, some embodiments of a beverage dispensing system 100 include a diffuser block 102 located immediately upstream of an extension element 104, a transition plate 106 and a diffuser assembly 108 provided within an external port nozzle 114. One or more sealing rings 110, 112 of various sizes may be provided to seal the coupling between the diffuser assembly 108 and the external port nozzle 114. The sealing rings 110, 112 may include O-rings for frictional assembly and sealing of the diffuser assembly 108 and/or the external port nozzle 114. The sealing rings 110, 112 may include an elastic or deformable material, such as a silicone, rubber, or polymer, to enhance sealing when the assembly is inserted into a beverage dispenser. It is appreciated that any number of sealing rings may be used, as well as various other interfacing or sealing features.

The diffuser block 102, the extension element 104, the transition plate 106, the diffuser assembly 108 and the external port nozzle 114 may be coupled together via one or more alignment and/or attachment features 150, 152, 154, 156 configured to engage with each other for proper assembly and attachment of the beverage dispensing system 100. For example, the alignment and/or attachment feature 150 may be provided on the diffuser block 102, the alignment and/or attachment feature 152 may be provided on the extension element 104, the alignment and/or attachment feature 154 may be provided on the transition plate 106, the alignment and/or attachment feature 156 may be provided on the diffuser assembly 108. In some embodiments, the alignment and/or attachment features 150, 152, 154, 156 may each include a hole that receivably engages a pin. When one or more pins are threaded through the alignment and/or attachment features 150, 152, 154, 156, the diffuser block 102, the extension element 104, the transition plate 106, the diffuser assembly 108 and the external port nozzle 114 may stay coupled together.

The beverage dispensing system 100 may receive beverage fluids such as water from a water source (not shown), carbonated water from a carbonator (not shown), and/or one or more beverage additives from beverage additive sources (not shown) at receiving ports provided on a top surface of the diffuser block 102. A beverage additive can be, for example, tea flavorings, coffee flavorings, vitamin shots, sweetener shots, concentrated soft drink syrups, etc. One or more beverage additives can be transferred from the beverage additive sources to the beverage dispensing system 100. The one or more beverage sources can include bag-in-box systems, as will be understood by those of ordinary skill in the art. One of ordinary skill in the art will appreciate that the beverage dispensing system 100 is not limited to the beverages and beverage sources discussed herein and may be used with other beverage fluids and other beverage sources.

The beverage dispensing system 100 may dispense one or more beverage fluids used to make a beverage. As used herein, a "beverage fluid" refers to any fluid constituent of a beverage, for example, a beverage additive, water, carbonated water, various types of alcoholic beverages, or any other beverage fluid constituent. The beverage dispensing system 100 can also be capable of dispensing a mixed beverage by mixing one or more beverage additives with a base beverage fluid such as non-carbonated water and/or carbonated water, or by mixing two or more beverages or beverage constituents together. The beverage dispensing system 100 can also be capable of dispensing a beverage that does not necessarily require mixing. For example, the beverage dispensing system 100 may dispense water, carbonated water, wine, beer, juice, spirits, premixed soft drinks or cocktails.

Additionally, the beverage dispensing system 100 may dispense carbonated beverages by adding carbon dioxide to a mixed beverage or by mixing carbonated water with a beverage additive. The beverage dispensing system 100 may dispense many different types of flavorings or beverage additives, flavored beverages, and mixed beverages. For instance, different tea flavorings can be provided to the beverage dispensing system 100 to create a variety of mixed tea beverages. The beverage dispensing system 100 may dispense various flavorings and beverages, including but not limited to water, tea, coffee, juices, energy drinks, vitamin-fortified beverages, sodas, beer, wine, spirits, or cocktails.

The diffuser block 102 of the beverage dispensing system 100 receives a plurality of beverage fluids at receiving ports provided on a top surface of the diffuser block 102. The beverage fluids may be received from a corresponding plurality of supply lines. An exemplary diffuser block 102 is described in detail in the U.S. patent application Ser. No. 13/220,546, filed Aug. 29, 2011, titled "Manifold System for Beverage Dispenser", the contents of which is incorporated herein in its entirety.

Dispensing of a post-mix beverage along with a non-mixed beverage is described next in connection with FIGS. 1A-1C. According to various embodiments, a base fluid (e.g. a first beverage fluid) may be dispensed at a primary outlet 180 (e.g. a dispensing port of a fluid channel) provided on a bottom surface of the diffuser block 102. The base fluid may flow through a primary outlet port 182 (e.g. a dispensing port of a fluid channel) provided on a bottom surface of the extension element 104 and a primary outlet port 184 provided on a bottom surface of the transition plate 106. The primary outlet ports 180, 182 and 184 are in fluid communication with each other. For example, the primary outlet ports 180, 182 and 184 may be aligned with each other.

As used herein, the bottom surface may refer to the surface of a structural element facing vertically downward in a vertical direction (e.g. in the gravitational direction). As used herein, a fluid channel terminates in an outlet port (e.g. a through hole), substantially perpendicular to the plane of the components of the beverage dispensing system 100, such that it is substantially vertical in use.

At least one beverage additive (e.g. a second beverage fluid) may be dispensed at one or more of the plurality of secondary outlet ports 190 provided on the bottom surface of the diffuser block 102. According to various embodiments, the secondary outlet ports 190 may be disposed around the primary outlet port 180 of the diffuser block 102. For example, the secondary outlet ports 190 may be radially disposed around the primary outlet port 180. The beverage additive(s) may flow through one or more of the plurality of secondary outlet ports 192 of the extension element 104 and one or more of the plurality of inner outlet ports 194 of the transition plate 106. The outlet ports 190, 192 and 194 are in fluid communication with each other. According to various embodiments, the secondary outlet ports 192 may be disposed around the primary outlet port 182 provided on a bottom surface of the extension element 104. For example, the secondary outlet ports 192 may be radially disposed around the primary outlet port 182. According to various embodiments, the inner outlet ports 194 may be disposed around the primary outlet port 184 provided on a bottom surface of the transition plate 106. For example, the inner outlet ports 194 may be radially disposed around the primary outlet port 184.

The base beverage (e.g. the first beverage fluid) and the beverage additive (e.g. the second beverage fluid) may be provided to and mixed within the diffuser assembly 108 into a post-mix beverage fluid. The post-mix beverage fluid (e.g. the mixture of the base fluid and the beverage additive(s)) may be dispensed at fluid outlet ports 196 of the diffuser assembly 108. An exemplary diffuser assembly 108 is described in detail in the U.S. patent application Ser. No. 14/253,736, filed Apr. 15, 2014, titled "Dispense Point Isolation Device", the contents of which is incorporated herein in its entirety. The post-mix beverage may be dispensed through a primary outlet port 308 provided at a bottom surface of the external port nozzle 114.

As illustrated in FIG. 1C, according to various embodiments, a non-mixed beverage (e.g. a second beverage fluid) may be dispensed at one or more of the secondary outlet ports 190 of the diffuser block 102. The non-mixed beverage may flow through one or more of the secondary outlet ports 192 of the extension element 104 corresponding to (e.g. in fluid communication with) the one or more secondary outlet ports 190 of the diffuser block 102. The non-mixed beverage may also flow through one or more of the outer channels 512 provided on a top surface 506 of the transition plate 106 and one or more of the outer outlet ports 502 provided on a bottom surface of the of the transition plate 106. As discussed in greater detail in connection with FIGS. 5A-5C, the outer channels 512 provided on the top surface 506 of the transition plate 106 correspond to (e.g. are in fluid communication with) the one or more secondary outlet ports 192 of the extension element 104. The outer outlet ports 502 provided on the bottom surface 508 of the transition plate 106 correspond to (e.g. are in fluid communication with) one or more inlet ports 336 of the external port nozzle 114.

Accordingly, the non-mixed beverage may be dispensed through one or more fluid outlet ports 306 of the external port nozzle 114 before, simultaneously with, or after the post-mix beverage is dispensed through the primary outlet port 308 of the external port nozzle 114. As discussed in greater detail in connection with FIGS. 3A-3E, the primary outlet port 308 of the external port nozzle receives the post-mix beverage fluid (e.g. the mixture of the base fluid and the beverage additive(s)) may be dispensed from the fluid outlet ports 196 of the diffuser assembly 108.

Referring back to FIGS. 1A-1C, according to various embodiments, the diffuser assembly 108 may be coupled to the external port nozzle 114 via a coupling system (e.g. a bayonet lock) provided on the outer surface of the diffuser assembly 108. The external port nozzle 114 may be shaped and dimensioned to receive the diffuser assembly 108 therein. That is, the external port nozzle 114 may include a cavity that is configured to receive the diffuser assembly 108. Sealing rings 110, 112 may be provided around the diffuser assembly 108 to seal the coupling between the diffuser assembly 108 and the external port nozzle 114.

FIGS. 2A-2E illustrate the beverage dispensing system 100 in an assembled state such that the diffuser block 102, the extension element 104, the transition plate 106, the diffuser assembly 108 and the external port nozzle 114 are all coupled together. The diffuser assembly 108 fits into the external post nozzle 114 such that the diffuser assembly 108 is provided within the external port nozzle 114 and, as such, is not shown in FIGS. 2A-2E.

External Port Nozzle

Figure 3A:
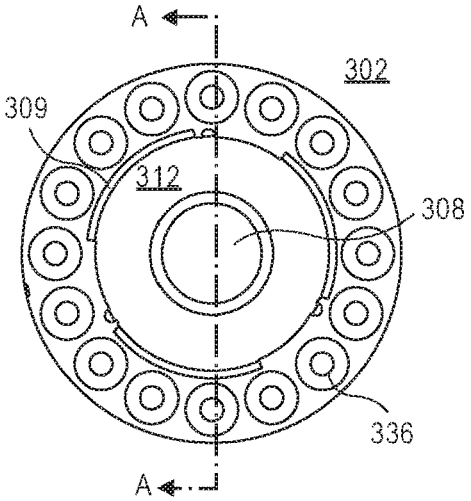
FIG. 3A is a bottom view of a first embodiment of the external port nozzle of the beverage dispensing system according to many embodiments.
Figure 3B:
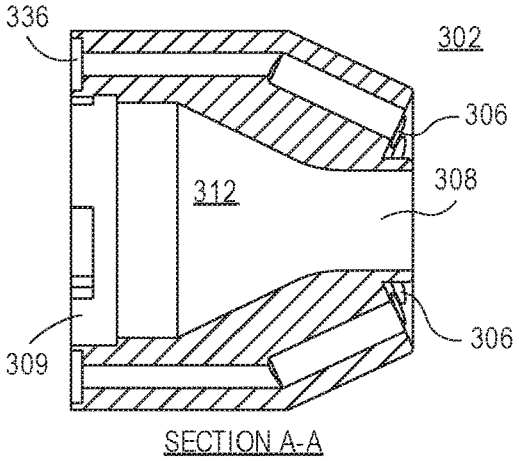
FIG. 3B is a cross-sectional view taken along section A-A of FIG. 3A.
Figure 3C:
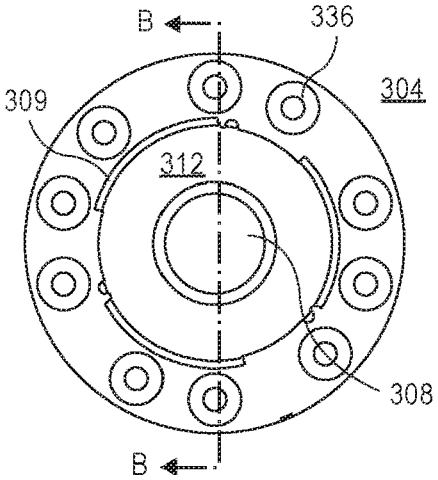
FIG. 3C is a bottom view of a second embodiment of the external port nozzle of the beverage dispensing system according to many embodiments.
Figure 3D:
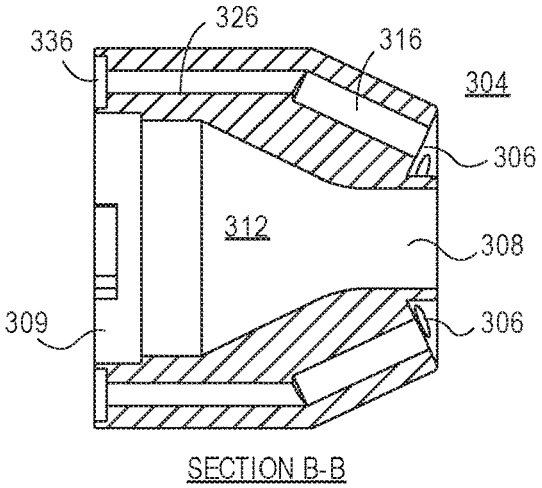
FIG. 3D is a cross-sectional view taken along section B-B of FIG. 3C.
Figure 3E:
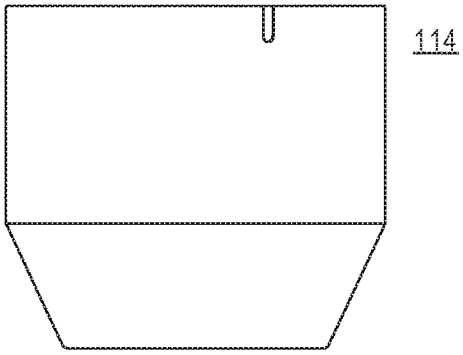
FIG. 3E illustrates a side view of the first embodiment of the external port nozzle of the beverage dispensing system as illustrated in FIG. 3A or the second embodiment of the external port nozzle of the beverage dispensing system as illustrated in FIG. 3C according to many embodiments.

FIGS. 3A-3B illustrate a first exemplary embodiment 302 of the external port nozzle 114 of the beverage dispensing system 100. FIGS. 3D-3E illustrate the second embodiment 304 of the external port nozzle 114 of the beverage dispensing system 100. FIG. 3E illustrates a side view of the first embodiment 302 or the second embodiment 304 of the external port nozzle 114. After the post-mix beverage is dispensed through the outlet ports 196 of the diffuser assembly 108, its flow can be partially or completely directed by the primary outlet port 308 of the external port nozzle 114 into a cup or other container (not shown). The external port nozzle 114 may be designed to minimize splash, splatter, and overspray of the dispensed beverage.

The external port nozzle 114 includes a plurality of fluid inlet ports 336 to direct a flow of the non-mixed fluid received from the outer outlet ports 502 of the transition plate 106. The fluid inlet ports 336 may be arranged in a radial array near an outside circumference of a top surface of the external port nozzle 114. A plurality of secondary outlet ports 306 that direct a flow of the non-mixed fluid may be formed at a bottom surface of the external port nozzle 114. The secondary outlet ports 306 may be arranged in a radial array near an outside circumference of the bottom surface of the external port nozzle 114. The secondary outlet ports 306 may be disposed radially around a primary outlet port 308. In some embodiments, the primary outlet port 308 may have a larger opening than each of the secondary outlet ports 306. The primary outlet port 308 may direct a flow of the post-mix fluid formed in the diffuser assembly 108 by mixing the base beverage with one or more beverage additives, as described above.

A given fluid inlet port 336 may be connected to a corresponding secondary outlet port 306 via a fluid channel. The fluid channel may be formed of a plurality of fluid channel portions 316 and 326. According to some embodiments, a first fluid channel portion 316 may be placed at an angle and a second fluid channel portion 326 may be straight to conform to the shape of the external port nozzle 114. The first fluid channel portion 316 and the second fluid channel portion 326 may form a continuous fluid path for the fluid from the fluid inlet port 336 toward the secondary outlet port 306.

The number of the fluid inlet ports 336 (and corresponding secondary outlet ports 306) provided on the first exemplary embodiment 302 may be different than the number of the fluid inlet ports 336 (and corresponding secondary outlet ports 306) provided on the second exemplary embodiment 304. In some embodiments, the number of the fluid inlet ports 336 of the external port nozzle 114 may be equivalent to the number of outer outlet ports 502 of the transition plate 106. Other than the number of the fluid inlet ports 336 (and corresponding secondary outlet ports 306), the structure of the first embodiment 302 and the second embodiment 304 of the external port nozzle 114 may be substantially similar.

The external port nozzle 114 is sized and dimensioned to receive the diffuser assembly 108 in an internal cavity (e.g. hollow chamber) 312 of the external port nozzle 114. In some embodiments, the diffuser assembly 108 may be completely embedded within the external port nozzle 114. The interior surface of the external port nozzle 114 (e.g. the wall of the internal cavity 312) may be structured to couple to the diffuser assembly 108 using a bayonet lock connector. According to various embodiments, the external port nozzle 114 may include surface features 309 for engaging the locking features of the diffuser assembly 108. In some embodiments, the diffuser assembly 108 may be coupled to the external port nozzle 114 via twist-lock features. According to various embodiments, one or more sealing ring(s) 110 may be provided between an inner surface of the external port nozzle 114 and an outer surface of the diffuser assembly 108.

As provided above, the diffuser assembly 108 may be configured to mix the base beverage (e.g. the first beverage fluid) received from the primary outlet port 184 of the transition plate 106 and the beverage additive (e.g. the second beverage fluid) received from the inner outlet ports 194 of the transition plate 106. Accordingly, the outlet port(s) 196 of the diffuser assembly 180 dispenses a post-mix beverage comprising the first beverage fluid and the second beverage fluid (as illustrated in FIG. 1C). The post-mix beverage is dispensed at the primary outlet port 308 of the external port nozzle 114.

In addition to dispensing the post-mix beverage at the primary outlet port 308, the external port nozzle is also configured to dispense a portion of the beverage additive or a non-mix beverage (e.g. the second beverage fluid) at the secondary outlet ports 306 of the external port nozzle 114 without mixing the beverage additive or a non-mix beverage with the base beverage or the post-mix beverage (as illustrated in FIG. 1C). The portion of the beverage additive or a non-mix beverage (e.g. the second beverage fluid) may be received at the inlet ports 336 of the external port nozzle 114 from the outer outlet ports 502 of the transition plate 106. That is, the inlet ports 336 of the external port nozzle 114 are in fluid communication with the outer outlet ports 502 of the transition plate 106. According to various embodiments, one or more sealing ring(s) 112 may be provided between an inlet port 336 of the external port nozzle 114 and an outer outlet port 502 of the transition plate 106.

Extension Element

Figure 4A:
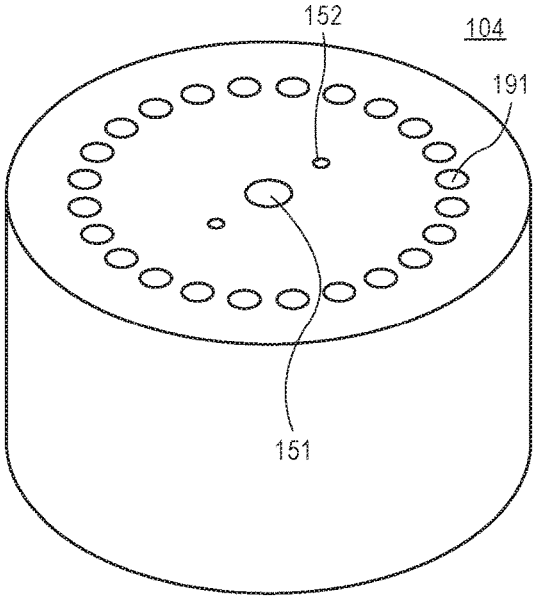
FIG. 4A is a perspective view of an extension element of the beverage dispensing system according to many embodiments.
Figure 4B:
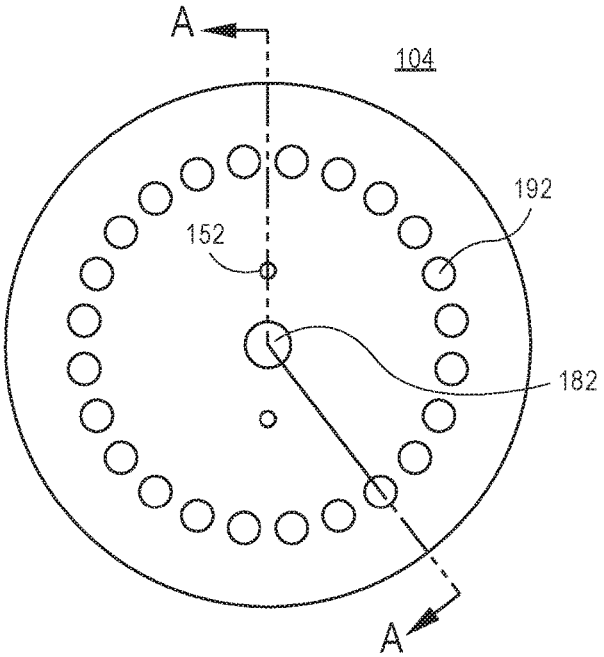
FIG. 4B is a bottom view of the extension element of the beverage dispensing system according to many embodiments.
Figure 4C:
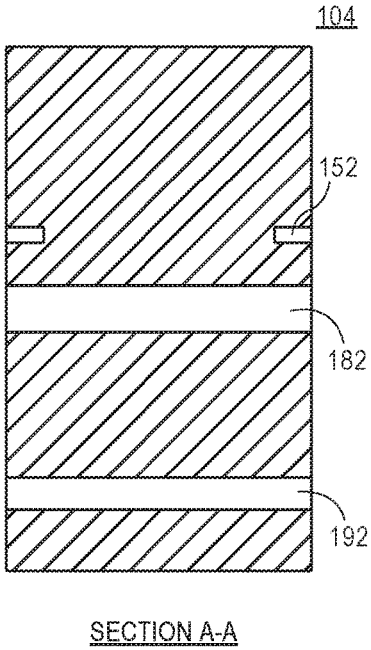
FIG. 4C is a cross-sectional view taken along section A-A of FIG. 4B.

FIGS. 4A-4C illustrate an extension element 104 (e.g. an extension plate, extension block, etc.) of the beverage dispensing system 100 according to many embodiments. The extension element 104 may have a custom-defined length based on the various end uses of the beverage dispensing system 100. In some embodiments, the extension element 104 may have variable length. For example, the extension element 104 may be a telescopic element having concentric tubular elements that may extend or retract in length. The extension element 104 may serve to increase the distance between the diffuser block 102 and the external port nozzle 114. That is, the transition plate 106 may be coupled to the diffuser block 102 via the extension element 104. For example, such configuration may reduce a distance between the external port nozzle 114 and a counter surface where the beverage dispensing system 100 is placed. Accordingly, the extension element 104 reduces the splash, splatter, and overspray of the dispensed beverage by bringing the external port nozzle 114 closer to a container that will receive the dispensed beverage.

The extension element 104 may serve to transfer the fluid dispensed from the diffuser block 102 to the transition plate 106. The extension element 104 may include a primary inlet port 151 provided on a top surface of the extension element 104. The primary inlet port 151 may be in fluid communication with the primary outlet port 180 of the diffuser block 102. extension element 104 may include a plurality of secondary inlet ports 191 provided around the primary inlet port 151 on the top surface of the extension element 104. The secondary inlet ports 191 may be in fluid communication with the secondary outlet ports 190 of the diffuser block 102. The extension element 104 may include a primary outlet port 182 provided on a bottom surface of the extension element 104. The primary outlet port 182 is in fluid communication with the primary inlet port 187 of the extension element 104. The extension element 104 may include a plurality of secondary outlet ports 192 provided on the bottom surface of the extension element 104. The plurality of secondary outlet ports 192 of the extension element 104 are in fluid communication with the plurality of inlet channels 510-512 of the extension element 106. In some embodiments, the extension element 104 may include one or more alignment and/or attachment features 152 on the top surface and/or the bottom surface for coupling to the diffuser block 102 and/or the transition plate 106, respectively.

Transition Plate

Figure 5A:
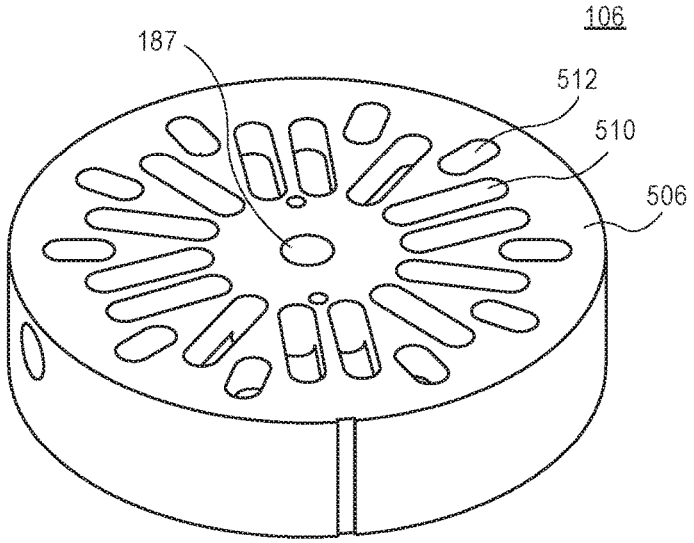
FIG. 5A is a perspective view of a transition plate of the beverage dispensing system according to many embodiments.
Figure 5B:
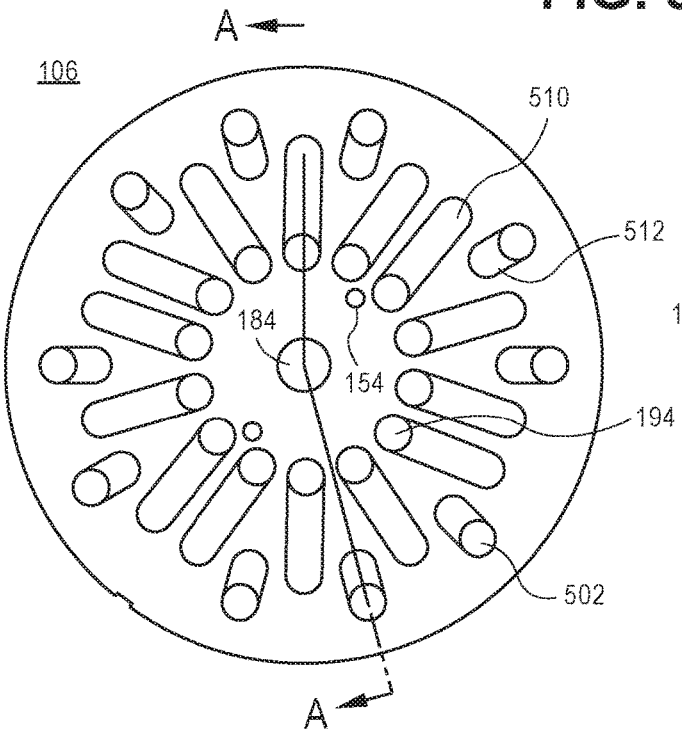
FIG. 5B is a bottom view of the transition plate of the beverage dispensing system according to many embodiments.
Figure 5C:
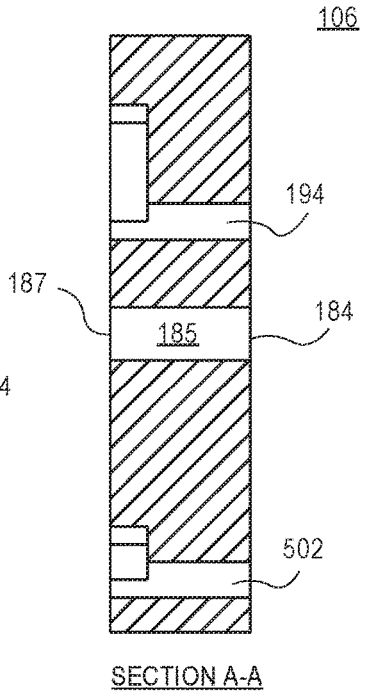
FIG. 5C is a cross-sectional view taken along section A-A of FIG. 5B.

FIGS. 5A-5C illustrate an exemplary transition plate 106 according to many embodiments. The transition plate 106 includes a top surface 506 facing the extension element 104 and a bottom surface 508 (illustrated in FIG. 1A) facing the external port nozzle 114. The bottom surface 508 includes a plurality of inner fluid outlet ports (e.g. fluid flow passages) 194 radially disposed around a primary fluid outlet port (e.g. fluid flow passage) 184. The primary outlet port 184 may be the dispensing orifice of a fluid channel 185 provided substantially at the center of the transition plate 106. The bottom surface 508 further includes a plurality of outer fluid outlet ports (e.g. fluid flow passages) 502 radially disposed around the inner fluid outlet ports 194. The top surface 506 of the transition plate 106 includes a plurality of long channels (e.g. grooves) 510 and a plurality of short channels (e.g. grooves) 512 radially disposed around a primary inlet port 187 of the transition plate 106.

Each one of the secondary outlet ports 192 of the extension element 104 corresponds to (e.g. is in fluid communication with) one of the channels 510 and 512 provided on the top surface 506 of the transition plate 106. A first portion of the fluid dispensed from the secondary outlet ports 192 of the extension element 104 may be received at the long channels 510 of the transition plate 106, and may be passed to one or more of inner fluid outlet ports 194 of the transition plate 106. For example, a first portion of the one or more beverage additives (e.g. second beverage fluid) dispensed at the secondary outlet ports 190 of the diffuser block 102 may pass through the secondary outlet ports 192 of the extension element 104, and may be received at the long channels 510 of the transition plate 106. The first portion of the one or more beverage additives may flow through each long channel 510 toward an inner outlet port 194 of the transition plate 106 to be provided to the secondary inlet ports 111 of the diffuser assembly 108 (as illustrated in FIG. 1C) to be mixed with the base fluid received at the primary inlet port 155 of the diffuser assembly 108. The post-mix beverage may be dispensed at the outlet ports 196 of the diffuser assembly 108 and the primary outlet port 308 of the external port nozzle 114.

On the other hand, a second portion of one or more beverage additives (e.g. second beverage fluid) dispensed at the secondary outlet ports 190 of the diffuser block 102 may pass through the secondary outlet ports 192 of the extension element 104, and may be received at the short channels 512 of the transition plate 106. The second portion of the one or more beverage additives may flow through each short channel 512 toward an outer fluid outlet port 502 of the transition plate 106 to be provided to the inlet ports 336 of external port nozzle 114 (as illustrated in FIG. 1C) to be dispensed at the secondary outlets 306 of the external port nozzle 114 before, after or concurrently with the post-mix beverage dispensed at the primary outlet 308 of the external port nozzle 114.

For example, the non-mixed fluid may be dispensed at the secondary outlet ports 190 of the diffuser block 102, pass through the secondary outlet ports 192 of the extension element 104, and may be received at the short channels 512 of the transition plate 106. Since the non-mixed fluid will not be mixed with the base beverage or other fluids in the diffuser assembly 108, the non-mixed fluid is not provided to the diffuser assembly 108. Rather, the outer fluid outlet ports 502 of the transition plate 106 provide the non-mixed fluid directly to the fluid inlet ports 336 of the external port nozzle 114. The non-mixed fluid by-passes the diffuser assembly 108 and reaches the fluid inlet ports 336 of the external port nozzle 114 directly from the outer fluid outlet ports 502 of the transition plate 106.

The transition plate 106 allows the beverage dispensing system 100 to dispense a post-mix beverage fluid at the primary fluid outlet port 308 of the external port nozzle 114 and a non-mixed beverage fluid at the one or more of the secondary outlet ports 306 of the external port nozzle 114 without having cross-contamination between the post-mix beverage fluid and the non-mixed beverage fluid. According to various embodiments, the non-mixed beverage fluid may be dispensed before, after or at the same time as (e.g. concurrently with) the post-mix beverage fluid.

In many embodiments, the external port nozzle disclosed above is configured to enable dispensing both post-mix and premix beverages from one (e.g. a single) nozzle assembly. For example, in some embodiments, the device may include a transition plate configured to couple with a conventional dispensing array, so that a user can improve an existing dispensing system through incorporation of a device in accordance with the present invention. Although in many embodiments, the external port nozzle is a separate component, it is appreciated that the features of the nozzle with isolation porting may be integrated with and/or incorporated into the diffuser assembly in a variety of ways, in accordance with the principles of the present invention.

The above description is illustrative and is not restrictive. A recitation of "a", "an" or "the" is intended to mean "one or more" unless specifically indicated to the contrary. Many variations of the disclosure will become apparent to those skilled in the art upon review of the disclosure. One or more features from any embodiment described herein may be combined with one or more features of any other embodiment without departing from the scope of the disclosure. The scope of the disclosure should, therefore, be determined not with reference to the above description, but instead should be determined with reference to the pending claims along with their full scope or equivalents.

What is claimed is:

1. A beverage dispensing system, comprising:

a diffuser block having a primary outlet port configured to dispense a first beverage fluid and a plurality of secondary outlet ports disposed around the primary outlet port, the secondary outlet ports configured to dispense a second beverage fluid;

a transition plate coupled to the diffuser block, the transition plate including:

a first set of channels provided on a top surface of the transition plate, wherein at least one of the first set of channels is in fluid communication with at least one of the secondary outlet ports of the diffuser block for receiving the second beverage fluid, a second set of channels provided on the top surface of the transition plate for receiving a non-mixed beverage, a plurality of inner outlet ports, provided on a bottom surface of the transition plate, in fluid communication with the first set of channels of the transition plate forming a first path for the second beverage fluid, and a plurality of outer outlet ports, provided on the bottom surface of the transition plate, in fluid communication with the second set of channels of the transition plate forming a second path for the non-mixed beverage; and an external port nozzle coupled to the transition plate, wherein the external port nozzle includes a primary outlet port extending along the first path and a plurality of secondary outlet ports disposed around the primary outlet port, wherein at least one of the secondary outlet ports of the external port nozzle extends along the second path and is in fluid communication with at least one of the outer outlet ports of the transition plate, wherein the non-mixed beverage flows through the second path without intersecting with the first path such that the non-mixed beverage is dispensed at the at least one of the secondary outlet ports of the external port nozzle without being mixed with the first beverage fluid or the second beverage fluid, wherein the transition plate further comprises:

a primary inlet port provided on the top surface of the transition plate, wherein the first set of channels are disposed around the primary inlet port, wherein the primary inlet port is in fluid communication with the primary outlet port of the diffuser block forming a third path for receiving the first beverage fluid, wherein the third path intersects with the first path at the primary outlet port of the external port nozzle to mix the first beverage fluid and the second beverage fluid into a mixed beverage; and a primary outlet port, provided on the bottom surface of the transition plate, in fluid communication with the primary inlet port of the transition plate and extending along the third path; and a diffuser assembly provided in a hollow cavity of the external port nozzle such that the diffuser assembly is embedded within the external port nozzle, wherein the diffuser assembly is configured to mix the first beverage fluid received from the primary outlet port of the transition plate and the second beverage fluid received from the inner outlet ports of the transition plate such that an outlet port of the diffuser assembly dispenses the mixed beverage.

2. The beverage dispensing system of claim 1, further comprising:

an extension element provided between the diffuser block and the transition plate such that the transition plate is coupled to the diffuser block via the extension element.

3. The beverage dispensing system of claim 2, wherein the extension element includes:

a primary inlet port provided on a top surface of the extension element, wherein the primary inlet port is in fluid communication with the primary outlet port of the diffuser block, a plurality of secondary inlet ports provided around the primary inlet port on the top surface of the extension element, wherein the secondary inlet ports are in fluid communication with the secondary outlet ports of the diffuser block, a primary outlet port provided on a bottom surface of the extension element, wherein the primary outlet port is in fluid communication with the primary inlet port of the extension element, and a plurality of secondary outlet ports provided on the bottom surface of the extension element, wherein the plurality of secondary outlet ports are in fluid communication with the plurality of secondary inlet ports of the extension element.

4. The beverage dispensing system of claim 3, wherein the secondary outlet ports of the extension element are in fluid communication with the first set of channels or the second set of channels provided on the top surface of the transition plate.

5. The beverage dispensing system of claim 1, further comprising:

at least one sealing ring provided between an inner surface of the external port nozzle and an outer surface of the diffuser assembly.

6. The beverage dispensing system of claim 1, wherein the external port nozzle includes a plurality of inlet ports provided on a top surface of the external port nozzle, the inlet ports being in fluid communication with the outer outlet ports of the transition plate.

7. The beverage dispensing system of claim 6, further comprising:

a sealing ring provided between one of the inlet ports of the external port nozzle and one of the outer outlet ports of the transition plate.

8. The beverage dispensing system of claim 1, wherein the non-mixed beverage is dispensed before or after the mixed beverage.

* * * * *